US005957297A

United States Patent [19]

Erämaja

[11] Patent Number: 5,957,297

[45] **Date of Patent: *Sep. 28, 1999**

[54] APPARATUS FOR SEPARATING HEAVY PARTICLES OF MATERIAL FROM LIGHTER ONES

[75] Inventor: Markku Erämaja, Valko, Finland

[73] Assignee: Sunds Defibrator Loviisa Oy, Valko, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/715,453

[22] Filed: Sep. 18, 1996

[30] Foreign Application Priority Data

Sep. 18, 1995 [FI] Finland ..... 954388

[51] Int. Cl.[6] ..... B07B 4/00; B03B 7/00

[52] U.S. Cl. ..... 209/20; 209/139.1; 209/468; 209/137; 209/502

[58] Field of Search ..... 209/20, 691, 693, 209/695, 134, 136, 137, 138, 139.1, 142, 468, 469, 467, 466, 484, 502; 406/78, 138, 137, 136; 198/382, 493; 137/599, 601

[56] References Cited

U.S. PATENT DOCUMENTS

| | | | |
|---|---|---|---|
| 1,192,159 | 7/1916 | Blauvet et al. | 209/134 |
| 2,125,330 | 8/1938 | Brisbane | 137/599 |
| 2,853,192 | 9/1958 | Berry | 209/469 |
| 2,903,132 | 9/1959 | Berry | 209/468 |
| 3,002,524 | 10/1961 | Diesing et al. | 137/599 |
| 3,065,853 | 11/1962 | Binnix | 209/468 |
| 3,433,257 | 3/1969 | Jensen | 137/599 |
| 3,477,467 | 11/1969 | Sewell et al. | 137/599 |
| 3,478,769 | 11/1969 | Zavod et al. | 137/599 |
| 3,603,349 | 9/1971 | Botnick | 137/599 |
| 3,799,334 | 3/1974 | Collins | 209/470 |
| 4,095,534 | 6/1978 | Goidich | 137/601 |
| 4,124,066 | 11/1978 | Taylor | 137/601 |
| 4,279,740 | 7/1981 | Isogaya | 209/12 |
| 4,692,068 | 9/1987 | Hanrot | 409/89 |
| 4,747,942 | 5/1988 | Struss | 209/455 |
| 4,755,284 | 7/1988 | Brooks | 209/20 |
| 4,840,727 | 6/1989 | Humphrey | 209/134 |
| 5,006,226 | 4/1991 | Burt | 209/19 |
| 5,141,026 | 8/1992 | Collette | 137/601 |
| 5,183,161 | 2/1993 | Mueller | 209/467 |
| 5,301,811 | 4/1994 | Mueller | 209/467 |
| 5,303,826 | 4/1994 | Buzga | 209/46 |
| 5,524,746 | 6/1996 | Massen | 198/443 |
| 5,580,307 | 12/1996 | Arosio et al. | 137/601 |

FOREIGN PATENT DOCUMENTS

| | | | |
|---|---|---|---|
| 1388033 | 12/1964 | France . | |
| 1388033 | 11/1965 | France . | |
| 532388 | 8/1931 | Germany . | |
| 344802 | 3/1931 | United Kingdom . | |
| 447229 | 5/1936 | United Kingdom | 209/468 |
| 758775 | 10/1956 | United Kingdom . | |

*Primary Examiner*—William E. Terrell
*Assistant Examiner*—Wonki K. Park
*Attorney, Agent, or Firm*—Birch, Stewart, Kolasch & Birch, LLP

[57] ABSTRACT

Apparatus for separating heavy particles of material from lighter particles, e.g. for separating impurities from powdery or fragmental material, such as fibers or chips. The apparatus includes a carrier surface (1) which is pervious to gas, onto which the material (2) to be treated is supplied, as well as a device for applying gas impacts through the carrier surface (1) to the material (2) to be treated. The apparatus includes special valve elements (4) disposed below the carrier surface (1) to produce gas impacts.

16 Claims, 2 Drawing Sheets

APPARATUS FOR SEPARATING HEAVY PARTICLES OF MATERIAL FROM LIGHTER ONES

FIELD OF THE INVENTION

The present invention relates to an apparatus as defined in the preamble of claim 1 for separating heavy particles of material from lighter ones, e.g. in mineral separation technology or for separating impurities from powdery or fragmental material, such as chip or fiber material.

BACKGROUND ART

Examples of powdery or fragmental materials are different fibers, chippings and wood chips used in the manufacture of chipboard or fiberboard and the like. In the manufacture of such boards, increasing use is being made of waste material. This has led to a need to remove impurities from the materials used for board manufacture. Such impurities include various minerals, rocks, sand, etc. Solutions are known in which impurities are separated from materials by merely using an air current. These solutions have the drawbacks of high energy consumption and dust emissions. Moreover, in purification based on the use of a gas flow, fine impurities cannot be removed as desired, leading to an unsatisfactory purification result.

In mineral separation technology, a known method is dry jigging or pulse separation. In pulse separation, short gas impacts are applied from below to material flowing on a carrier surface pervious to gas. The lifting effect of the gas impact on a heavier particle is smaller than on a lighter particle because of the lower acceleration of the former. Therefore, the lighter particles, which have risen higher during the gas impact, come down more slowly during the intermission and are concentrated in the top part of the material layer. The heavier particles are concentrated in the bottom part of the layer. To separate the layers, they must be moved from the input end of the carrier surface towards its output end. The movement is achieved e.g. by using directional vibration, and the separation is performed e.g. at the output end by using a separating knife or, before it, a screw that moves the bottom layer to one side of the apparatus. The separation of the aforesaid layers has been determined according to the highest mineral quantity. In this case, the mineral content of the bottom layer is usually only 10–50%, which means that further enrichment is required. Different materials present different requirements regarding the gas impact/intermission ratio, pulse number and impact intensity. In known devices, a blast apparatus, a rotary valve and piping and gas distribution below the plane are not applicable for the separation of finegrained minerals. The large volume of such gas apparatus interferes with the advance of fast pulses to the separation plane, so they are only applicable for rough separation.

The problem is how to achieve a sharp gas impact and a high pulse number uniformly e.g. on a large surface.

SUMMARY OF THE INVENTION

The object of the present invention is to achieve a comb pletely new separating apparatus that obviates the drawbacks of prior-art solutions.

The invention is characterized by what is presented in the claims.

The solution of the invention has numerous significant advantages. By disposing the elements producing gas impacts substantially below the carrier surface, very sharp gas impacts improving the separating efficiency are achieved. By arranging the valve elements producing gas impacts substantially over the whole width and length of the material treating area of the carrier surface, an extremely homogeneous gas impact on the material being treated is achieved. Due to rotatable valve elements, very high numbers of gas impacts per unit time, i.e. pulse numbers, are achieved. By placing these valve elements in a substantially parallel arrangement side by side, so that the valve elements are usually in contact with each other when in the closed position and have a gap between them when in the open position, a very advantageous and efficient valve system is achieved. With the solution of the invention, a good tightness can be achieved. When the valve system is in its open position, it distributes the gas impact in the desired manner substantially across the whole width of the carrier surface. By forming the valve elements using rollers having at least one cut-out, recess or groove or equivalent on their circumferences, a very advantageous and reliable valve element solution is achieved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described by referring to the attached drawings, drawings which are given by way of illustration only, and thus are not limitative of the present invention, and in which.

DESCRIPTION OF THE PREFERRED EMBODIMENTS

Figure 1:
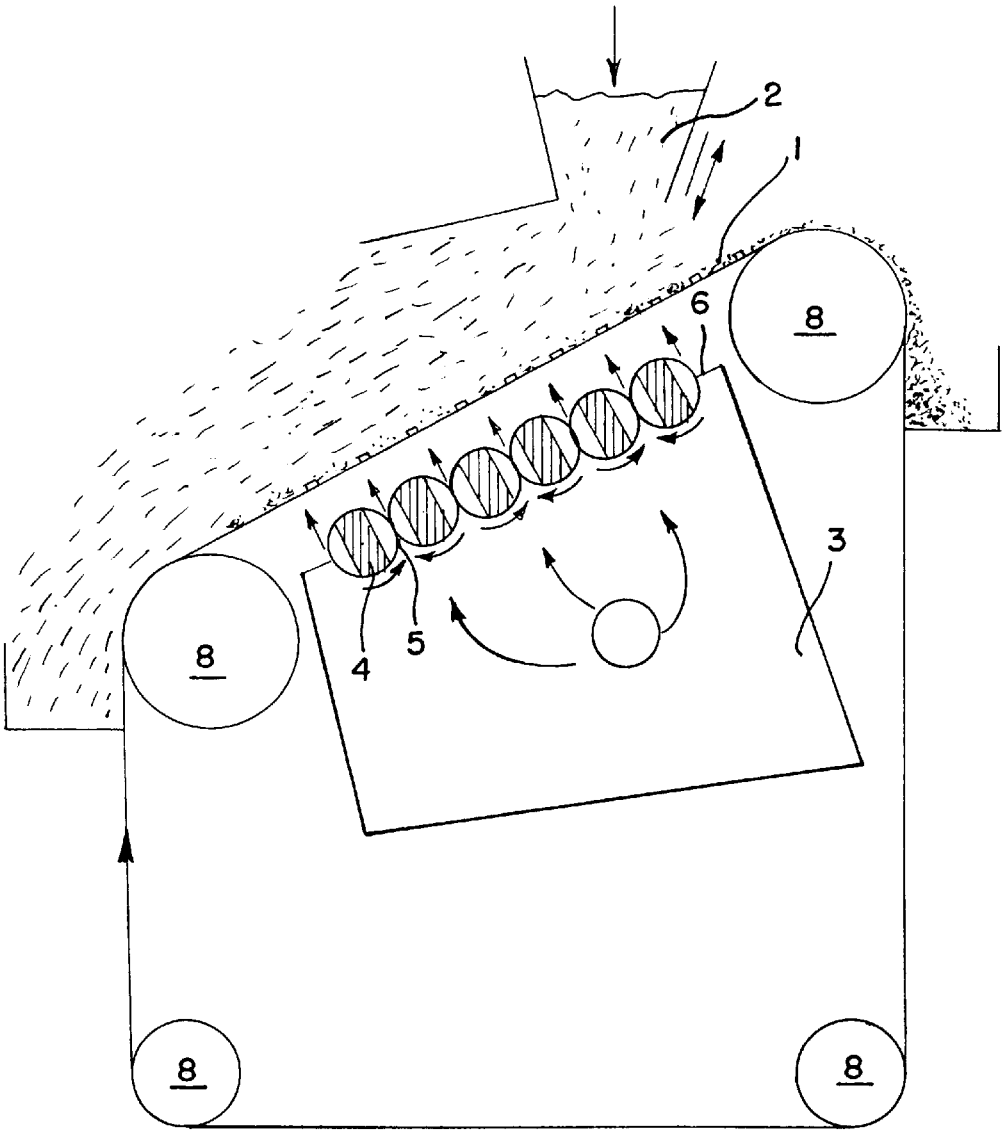
FIG. 1 presents an apparatus of the invention in simplified side view.
Figure 2:
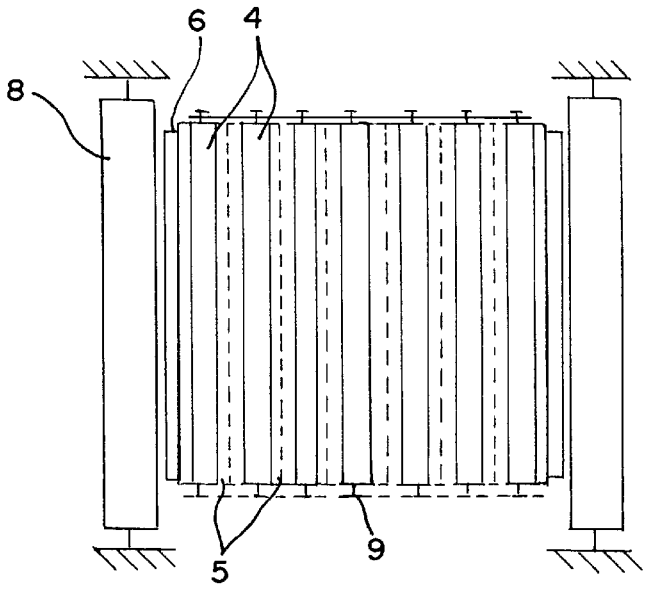
FIG. 2 presents another embodiment of the apparatus of the invention in top view with the valve elements in the open position.

The apparatus of the invention comprises a carrier surface 1 pervious to gas, onto which the material to be treated is supplied. The apparatus in the figure has an inclined carrier surface 1, and the material to be treated is preferably supplied onto it from the upper end. The carrier surface 1 may consist of any known carrier which is provided with means for moving the material and separating material layers. The carrier 1 is e.g. an inclined endless belt which is moved in the direction indicated by the arrows, the inclined portion being moved in an upward direction. Disposed below the carrier 1 are means 3, 4 for producing gas impacts and applying them through the carrier surface 1 to the material flow. The means for producing gas impacts comprise a chamber 3 disposed under the carrier surface 1, into which chamber gas is supplied and whose wall opposite to the carrier 1 is provided with at least one aperture, and at least one valve element 4 substantially close to the carrier surface 1 for regulating and/or closing the gas flow passing through the aperture/apertures, by means of which the gas impacts are thus produced.

The valve element 4, or a group formed by a number of valve elements, extends substantially over the whole width and/or length of the material treating area of the carrier surface 1, preferably over the width and length of the carrier surface.

In the open position, the valve element 4 or group of valve elements forms at least one aperture 5 or group of apertures in the direction of the material flow on the carrier surface or preferably in a direction differing from it, which apertures permit the gas to flow from the chamber 3. The aperture 5, gap or equivalent formed by the valve element 4 in its open position extends substantially across the whole width of the material treating area on the carrier surface and/or there are several apertures, gaps or equivalent distributed over the width of the treatment area. There may be several valve elements 4 disposed in a side-by-side and/or interlaced arrangement. The valve element 4 is rotatable about its axis 9. Adjacent valve elements may be rotatable in the same direction or in opposite directions.

According to a preferred embodiment of the invention, at least one valve element 4 is disposed in at least one aperture in the chamber 3 wall opposite to the carrier surface 1. The valve elements 4 are preferably elements arranged in a transverse direction relative to the carrier surface, typically mainly of a width equal to that of the carrier surface 1 and rotatable about an axis transverse to the carrier surface 1. The valve element 4 is so designed that in its closed position it is substantially in contact with at least one sealing element 6 and/or an adjacent valve element 4, permitting no significant amounts of gas to flow from the chamber 3 via the aperture opposite to the carrier surface. In the open position at least one aperture appears between the valve element 4 and a sealing element and/or adjacent valve elements, permitting gas to be discharged from the chamber via the aperture and through the carrier surface. Preferably there are multiple valve elements 4 side by side, preferably placed substantially immediately below the carrier surface 1, each one of which produces during each revolution about its axis of rotation at least one gas impact applied in the open position to the carrier surface 1. In the embodiment illustrated by FIG. 1, the valve elements are rollers, each one of which is provided with at least one recess 5, cut-out, groove or equivalent. This recess 5 has been produced by e.g. by cutting out from a roller with a circular cross-section the portion remaining in the radial direction outside the straight line connecting the intersections of the sides of a segment and the circumference. The cut-outs 5, recesses or equivalent in adjacent rollers are preferably so designed that they face each other in the open position, permitting gas to flow through the apertures between the rollers.

In the case illustrated by the figure, the belt is moved by means of rollers 8, at least one of which is a driving roller.

The apparatus of the invention works as follows:

The material 2 to be treated, containing particles of heavier and lighter specific gravity, is supplied onto the inclined carrier surface 1 from its upper end, Short uplifting gas impacts are applied through the carrier surface 1 to the material flow. The gas impact has a smaller uplifting effect on a particle of heavier specific gravity than it has on a particle of lighter specific gravity, due to the lower acceleration of the former. On the inclined carrier surface 1, the lighter particles, which have risen higher during the gas impact, fall down during the intermission at some distance in the direction of the inclination. Thus, as a result of repeated gas impacts, the lighter particles are passed on faster in the direction of the inclination than the heavier particles. As the carrier is a belt conveyor 1 which is pervious to gas and moves in the up direction of the inclination at a velocity lower than the velocity of the light particles moving in the down direction of inclination but higher than the corresponding velocity of the heavy particles, the light particles move downwards whereas the heavy particles move upwards. In this way, particles of heavier specific gravity are separated from lighter particles. Light particles are thus removed from the carrier 1 via its lower end while heavier particles are removed via the upper end.

The gas impacts are produced by supplying gas, preferably air, into the chamber 3 below the carrier surface 1 and using valve elements 4 to repeatedly interrupt the gas flow directed at the carrier 1 from below. The valve elements 4 are preferably disposed immediately below the belt conveyor 1 or in its vicinity, thus ensuring a maximum effect of the gas impacts. The valve elements 4 are formed by substantially parallel rollers disposed side by side in an opening in the chamber 3 wall opposite to the carrier surface. The directions of rotation of the rollers are indicated in FIG. 1 by arrows. Adjacent rollers preferably rotate in opposite directions. The rollers preferably rotate in phase, so the nicks, cut-outs or equivalent in adjacent rollers are simultaneously in register. The size, shape and direction of the cut-outs 5 can be used to control the direction and form of the gas impact. The rollers 4 illustrated by the figures have two cut-outs formed at intervals of 180°. When the rollers are rotating, a gas impact is produced in the open position and an intermission in the closed position. Typically, gas impact pulses are produced e.g. at a rate of 1–10 pulses/s. The duration of a gas impact is typically 10–50% of the pulse duration. The rollers are rotated by a drive apparatus using e.g. a chain transmission.

Figure 3:
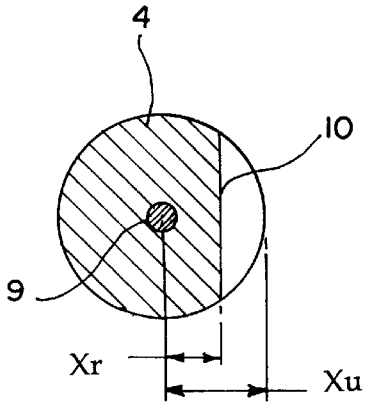
FIG. 3 presents a valve element as provided by the invention, sectioned along a plane perpendicular to the longitudinal axis.

Naturally, the valve elements may also be of a different shape. The essential point is that in at least one crosssectional plane perpendicular to the axis 9 of rotation of the valve element 4, the radial distance $X_r$ of at least one point on the outer surface of the valve element 4 from the axis 9 of rotation is smaller than the corresponding distance $X_u$ of the outermost circle of rotation of the outer surface (FIG. 3).

Thus, the valve elements can be implemented e.g. as elongated flat rods arranged side by side. The flat rods are moved into an open position so that at least one aperture is opened between them, and into a closed position so that the aperture is closed. The movement of the flat rods may be linear or rotary motion.

In a preferred embodiment, the chamber 3 is divided into several compartments using at least one partition, so that a different pressure can be used in different compartments of the chamber. In this case it is possible to produce a different gas impact from each compartment if required. Moreover, the carrier surface can be divided into several zones, in which case it is possible to achieve different pulse numbers, gas impact intensities etc. in different zones of the carrier surface. With these solutions, the separating capacity and efficiency of the apparatus can be further improved, It is obvious to a person skilled in the art that the invention is not restricted to the examples of its embodiments described above, but that it may instead be varied in the scope of the attached claims. Thus, besides being used for the separation of impurities from chip or fiber material, the invention can be used in other separation applications as well.

I claim:

1. An apparatus for separating heavy particles of material from lighter particles, comprising:

a gas pervious carrier surface for receiving material to be treated thereon, the gas pervious carrier surface being movable in a first direction for moving the heavy particles in the first direction; and means for applying intermittent gas impacts through the carrier surface for substantially moving the lighter particles in a second direction, generally opposite the first direction, said means for applying intermittent gas impacts comprising:

a gas filled chamber having a wall adjacent to the carrier surface, at least one opening in the wall; and a plurality of valve elements located in the opening along the carrier surface for intermittently allowing gas to flow therethrough.

2. The apparatus as defined in claim 1 wherein the at least one valve element extends substantially across the whole width of the material treatment area of the carrier surface.

3. The apparatus as defined in claim 1, wherein the at least one valve element extends substantially over the whole length of the material treatment area.

4. The apparatus as defined in claim 1, wherein the at least one aperture formed by the valve element extends substantially across the whole width of the material treatment area on the carrier surface.

5. The apparatus as defined in claim 1, wherein there are multiple valve elements disposed in a side-by-side or interlaced arrangement.

6. The apparatus as defined in claim 1, wherein the at least one valve element can be rotated is rotatable in one direction about its axis.

7. The apparatus as defined in claim 1, wherein in at least one cross-sectional plane perpendicular to the axis of rotation of the at least one valve element, the radial distance of at least one point on an outer surface of the at least one valve element from the axis of rotation is smaller than the radial distance of another point on the outer surface of the at least one valve element.

8. The apparatus of claim 7, wherein the at least one valve element is generally cylindrical in cross-section.

9. The apparatus of claim 8, wherein there are a plurality of the at least one valve element, and adjacent valve elements cooperate with each other to open and close an aperture therebetween, said aperture being opened when the smaller radial distance points of adjacent valves are aligned and closed when the larger radial distance points are aligned.

10. The apparatus as defined in claim 1, wherein adjacent valve elements rotate in the same direction.

11. The apparatus as defined in claim 1, wherein adjacent valve elements rotate in opposite directions.

12. The apparatus of claim 1, wherein the at least one valve element extends substantially across the width of the carrier surface.

13. The apparatus of claim 1, wherein the at least one valve element extends substantially over the length of the carrier surface.

14. The apparatus of claim 1, wherein the at least one valve element forms, in an open position, at least one aperture facing in a direction deviating from the first direction through which the gas can flow from the chamber.

15. The apparatus of claim 1, wherein the at least one valve element is rotatable in both directions about its axis.

16. The apparatus as defined in claim 1, wherein the carrier surface moves the heavy particles in the first direction to be collected at a first end of the carrier surface and the means for applying intermittent gas impacts moves the lighter particles in the second direction to be collected at a second end of the carrier surface, opposite the first end.

* * * * *